US010800173B2

(12) United States Patent
Kakiuchi

(10) Patent No.: US 10,800,173 B2
(45) Date of Patent: Oct. 13, 2020

(54) LIQUID JETTING APPARATUS

(71) Applicant: Brother Kogyo Kabushiki Kaisha, Nagoya-shi, Aichi-ken (JP)

(72) Inventor: Toru Kakiuchi, Chita-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/261,944

(22) Filed: Jan. 30, 2019

(65) Prior Publication Data

US 2019/0299612 A1 Oct. 3, 2019

(30) Foreign Application Priority Data

Mar. 30, 2018 (JP) ..... 2018-068302

(51) Int. Cl.
*B41J 2/14* (2006.01)

(52) U.S. Cl.
CPC ..... *B41J 2/14233* (2013.01); *B41J 2/14201* (2013.01); *B41J 2002/14241* (2013.01); *B41J 2002/14419* (2013.01); *B41J 2002/14491* (2013.01); *B41J 2202/18* (2013.01)

(58) Field of Classification Search
CPC ..... B41J 2/14233; B41J 2/14201; B41J 2002/14241; B41J 2002/14419; B41J 2202/18; B41J 2002/14491
See application file for complete search history.

(56) References Cited

U.S. PATENT DOCUMENTS

| | | | | |
|---|---|---|---|---|
| 7,712,885 | B2 * | 5/2010 | Kojima | B41J 2/055 347/94 |
| 8,042,917 | B2 | 10/2011 | Azumi | |
| 8,632,165 | B2 | 1/2014 | Akahane et al. | |
| 8,919,929 | B2 | 12/2014 | Akahane et al. | |
| 2008/0100674 | A1 | 5/2008 | Azumi | |
| 2012/0182354 | A1 | 7/2012 | Akahane et al. | |
| 2014/0118443 | A1 | 5/2014 | Akahane et al. | |

FOREIGN PATENT DOCUMENTS

| | | |
|---|---|---|
| JP | 2008-110571 A | 5/2008 |
| JP | 2012-143980 A | 8/2012 |

* cited by examiner

*Primary Examiner* — Geoffrey S Mruk
(74) *Attorney, Agent, or Firm* — Banner & Witcoff, Ltd.

(57) ABSTRACT

A liquid jetting apparatus includes: first pressure chambers aligned in a first direction; second pressure chambers aligned in the first direction and arranged at a distance from the first pressure chambers in a second direction orthogonal to the first direction; a first common channel extending in the first direction and communicating with the first pressure chambers; a second common channel extending in the first direction and communicating with the second pressure chambers; a third common channel extending in the first direction and communicating with the first and second pressure chambers; a substrate having a surface formed with the first and second pressure chambers and a space constituting at least part of the third common channel, vibration plates defining upper surfaces of the first and second pressure chambers, piezoelectric elements overlapping with the vibration plates, and a damper film defining an upper surface of the space.

20 Claims, 11 Drawing Sheets

LIQUID JETTING APPARATUS

CROSS REFERENCE TO RELATED APPLICATION

The present application claims priority from Japanese Patent Application No. 2018-068302 filed on Mar. 30, 2018, the disclosure of which is incorporated herein by reference in its entirety.

BACKGROUND

Field of the Invention

The present invention relates to a liquid jetting apparatus configured to jet liquid from nozzles.

Description of the Related Art

Conventionally, there is known an ink-jet type recording head including a channel substrate and two manifolds Which are provided outside the channel substrate and sealed with a sealing film being flexibly deformable. The channel substrate is formed with pressure generation chambers arranged in two rows and part of a circulation channel between the two rows of the pressure generation chambers.

SUMMARY

In such an ink-jet type recording head, it is desirable to cause ink to flow stably by absorbing vibration of the ink. However, in the ink-jet type recording head having the above configuration, no consideration is made about the vibration of the ink flowing through the channel formed between the two rows of the pressure generation chambers.

An object of the present teaching is to improve the effect of absorbing vibration of liquid inside a common channel, in a liquid jetting apparatus having a substrate where two pressure chamber rows and at least part of the common channel, which is formed in communication with the respective pressure chambers in the two pressure chamber rows.

According to an aspect of the present teaching, there is provided a liquid jetting apparatus including: first pressure chambers aligned in a first direction; second pressure chambers aligned in the first direction and arranged at a distance from the first pressure chambers in a second direction orthogonal to the first direction; a first common channel extending in the first direction and communicating with the first pressure chambers; a second common channel extending in the first direction and communicating with the second pressure chambers; a third common channel extending in the first direction and communicating with the first pressure chambers and the second pressure chambers; a substrate having a surface parallel to the first direction and the second direction and being formed with the first pressure chambers, the second pressure chambers, and a space constituting at least part of the third common channel; vibration plates defining upper surfaces of the first pressure chambers and the second pressure chambers; piezoelectric elements formed to overlap with the vibration plates respectively; and a damper film defining an upper surface of the space, wherein the space is arranged between the first pressure chambers and the second pressure chambers in the second direction to extend in the first direction, and the damper film covers an opening, on an upper surface side of the substrate, forming the space.

According to the above configuration, the damper film covers the opening of the space constituting at least part of the third common channel at the upper surface side of the substrate. Therefore, it is possible to improve the effect of absorbing the vibration of the liquid inside the third common channel which communicates with the first pressure chambers aligned in the first direction and the second pressure chambers aligned in the first direction.

DESCRIPTION OF THE EMBODIMENT

Hereinbelow referring to the accompanying drawings, an embodiment of the present teaching will be explained.

<Overall Configuration of a Printer>

Figure 1:
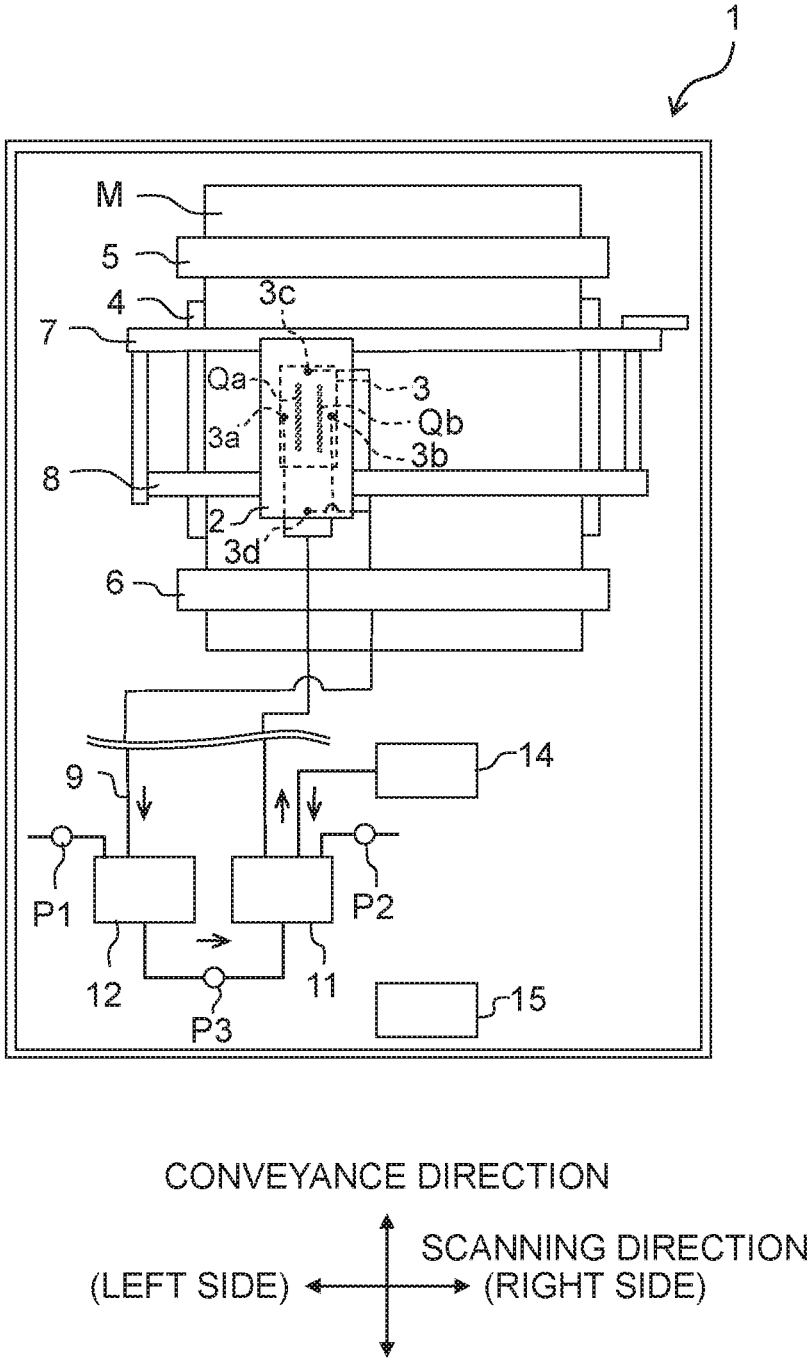
FIG. 1 is a schematic configuration diagram of a printer according to an embodiment of the present teaching.
Figure 2:
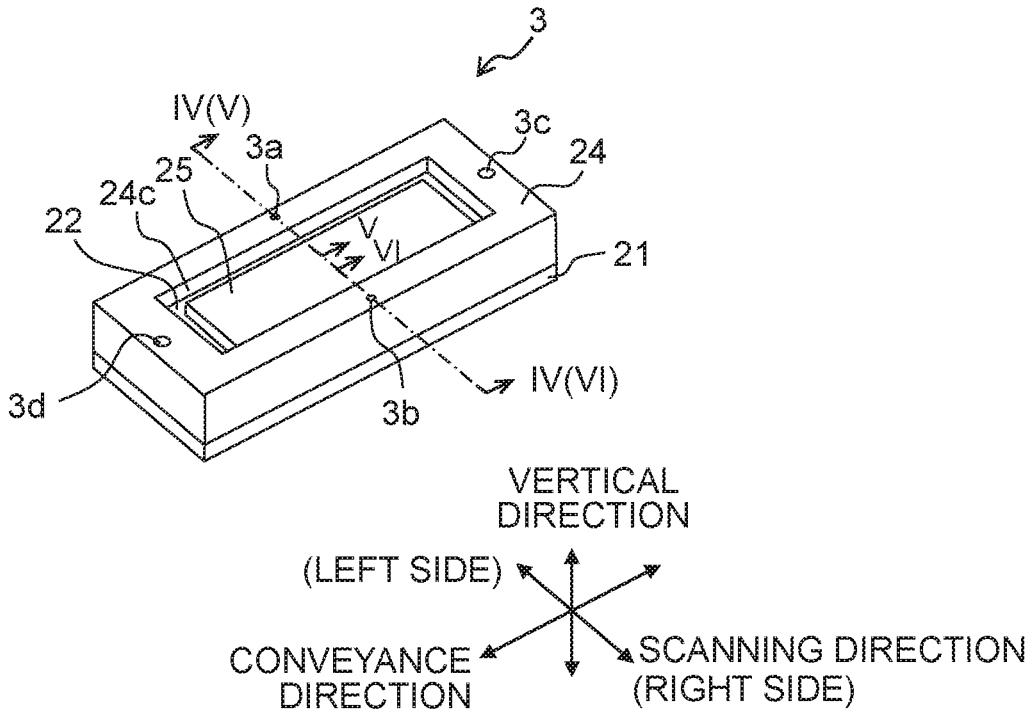
FIG. 2 is a perspective view of an ink jet head of FIG. 1.

As depicted in FIGS. 1 and 2, a printer 1 includes a carriage 2, an ink jet head 3, a platen 4, conveyance rollers 5 and 6, a pressurizing tank 11, a negative pressure tank 12, air pumps P1 and P2, an ink pump P3, a tank 14, and a controller 15.

The carriage 2 is supported by two guide rails 7 and 8 extending in a scanning direction and, along the guide rails 7 and 8, moves reciprocatingly in the scanning direction together with the ink jet head 3. Hereinbelow, the right side of the page of FIG. 1 is defined as the right side in the scanning direction whereas the left side of the page is defined as the right side in the scanning direction.

The ink jet head 3 is an exemplary liquid jetting apparatus, and is mounted on the carriage 2. The ink jet head 3 is, as will be described later on, provided with a total of 800 nozzles 20*a* and 20*b* (see FIG. 4) to jet ink as an example of liquid, two supply ports 3*a* and 3*b*, and two discharge ports 3*c* and 3*d*.

The supply ports 3*a* and 3*b* are connected with a pair of branched upstream ends of a pipe 9, while the discharge ports 3*c* and 3*d* are connected with a pair of branched downstream ends of the pipe 9. The pipe 9 is connected midway with the pressurizing tank 11, the negative pressure tank 12, and the ink pump P3. The ink is stored in the pressurizing tank. The pressurizing tank 11 is connected with the air pump P2 pressurizing the ink with air, and the supply tank 14 supplying the ink to the pressurizing tank 11. The pressurizing tank 11 is connected to such a part of the pipe 9 as close to the supply ports 3*a* and 3*b*. With the air pump P2 raising the pressure of the air in the pressurizing tank 11, the ink in the pressurizing tank 11 is pressurized to be supplied to the pipe 9.

The ink is also stored in the negative pressure tank 12. The negative pressure tank 12 is connected with the air pump P1 depressurizing the ink with air. The negative pressure tank 12 is connected to such a part of the pipe 9 as close to the discharge ports 3*c* and 3*d*. With the air pump P1 lowering the pressure of the air in the negative pressure tank 12, part of the ink flowing through the pipe 9 is sucked into the negative pressure tank 12.

The ink pump P3 is arranged at a part of the pipe 9 between the tanks 11 and 12. The ink pump P3 supplies the ink from the negative pressure tank 12 to the pressurizing tank 11. In the printer 1, along with driving of the pumps P1 to P3, the ink circulates inside the pipe 9 and the ink jet head 3.

The platen 4 is arranged to face the nozzles 20*a* and 20*b* of the ink jet head 3, and extends in the scanning direction and in a conveyance direction orthogonal to the scanning direction. A recording sheet M is placed on the platen 4. The conveyance rollers 5 and 6 convey the recording sheet M along the conveyance direction. The conveyance roller 5 is arranged on the upstream side from the carriage 2 in the conveyance direction while the conveyance roller 6 is arranged on the downstream side from the carriage 2 in the conveyance direction. The controller 15 individually controls the carriage 2, the pumps P1 to P3, the conveyance rollers 5 and 6, and a total of 800 piezoelectric elements 34*a* and 34*b* (see FIG. 4), respectively.

In the printer 1, the controller 15 controls the conveyance rollers 5 and 6 to convey the recording sheet M each time in the conveyance direction by a predetermined distance. The controller 15 controls the 800 piezoelectric elements 34*a*, 34*b* of the ink jet head 3 to jet the ink from the nozzles 20*a* and 20*b* while controlling the carriage 2 to move the same in the scanning direction. By virtue of this, printing is carried out on the recording sheet M.

<Ink Jet Head>

Figure 3:
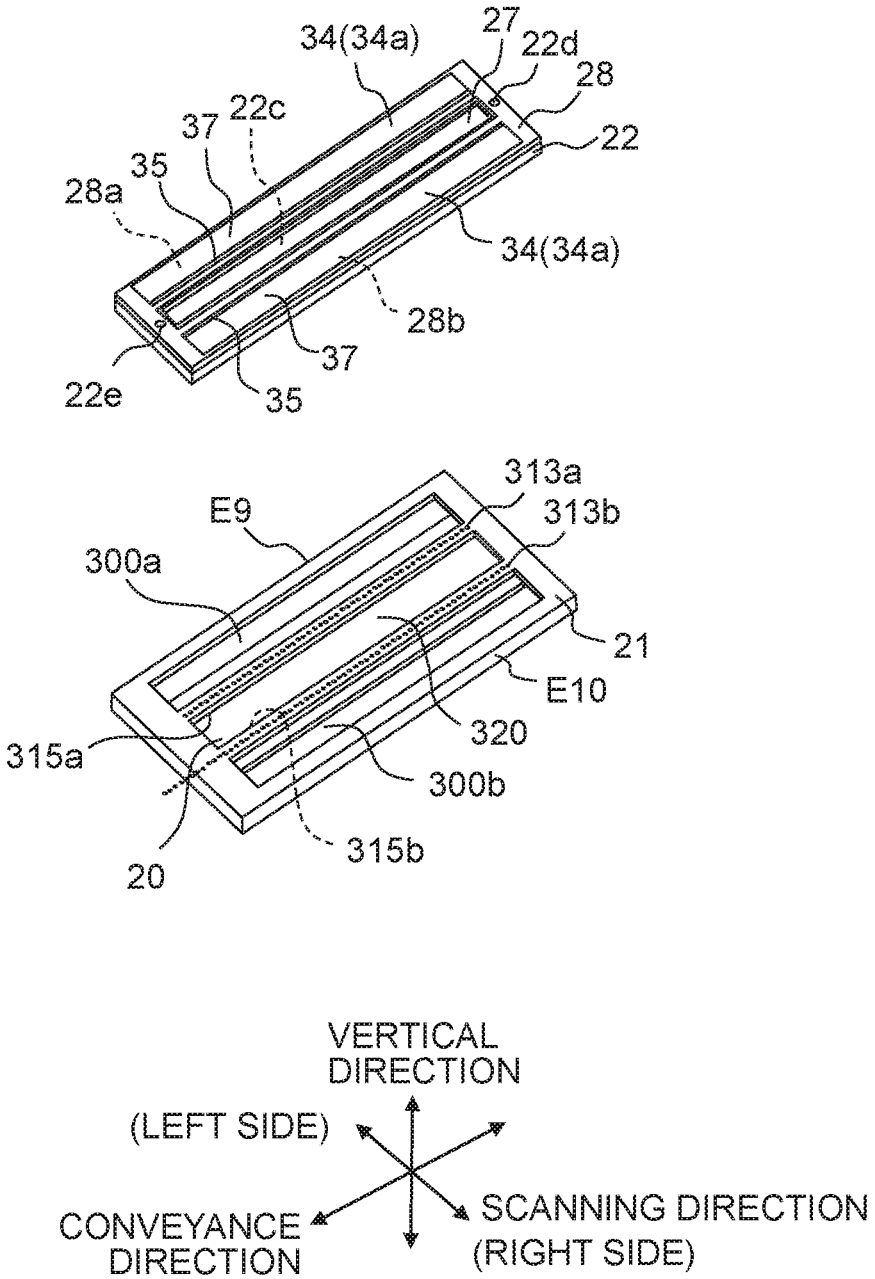
FIG. 3 is a perspective view of each substrate of the ink jet head of FIG. 1.
Figure 4:
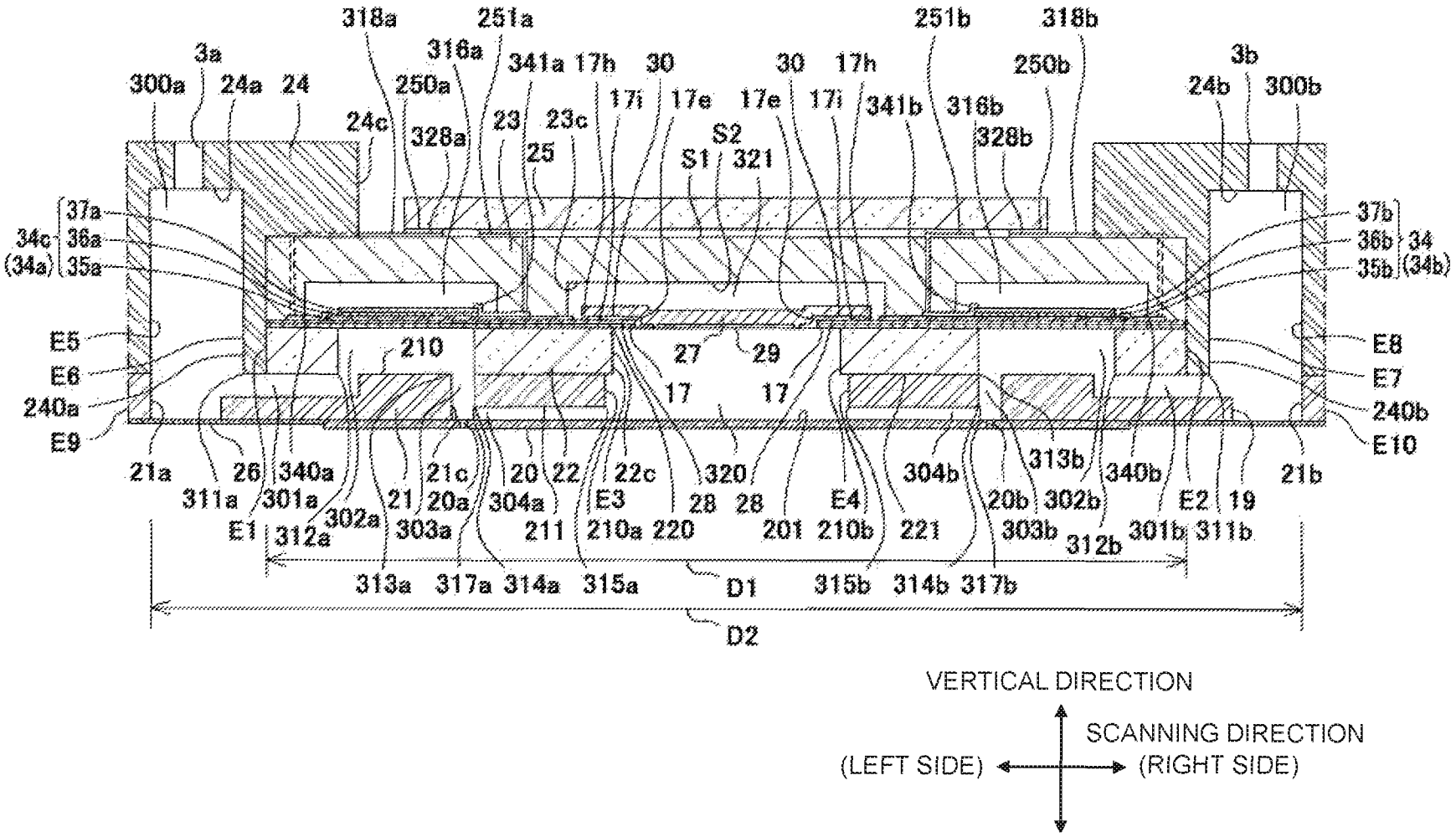
FIG. 4 is a cross-sectional view of the ink jet head of FIG. 2 along the line IV-IV.
Figure 5:
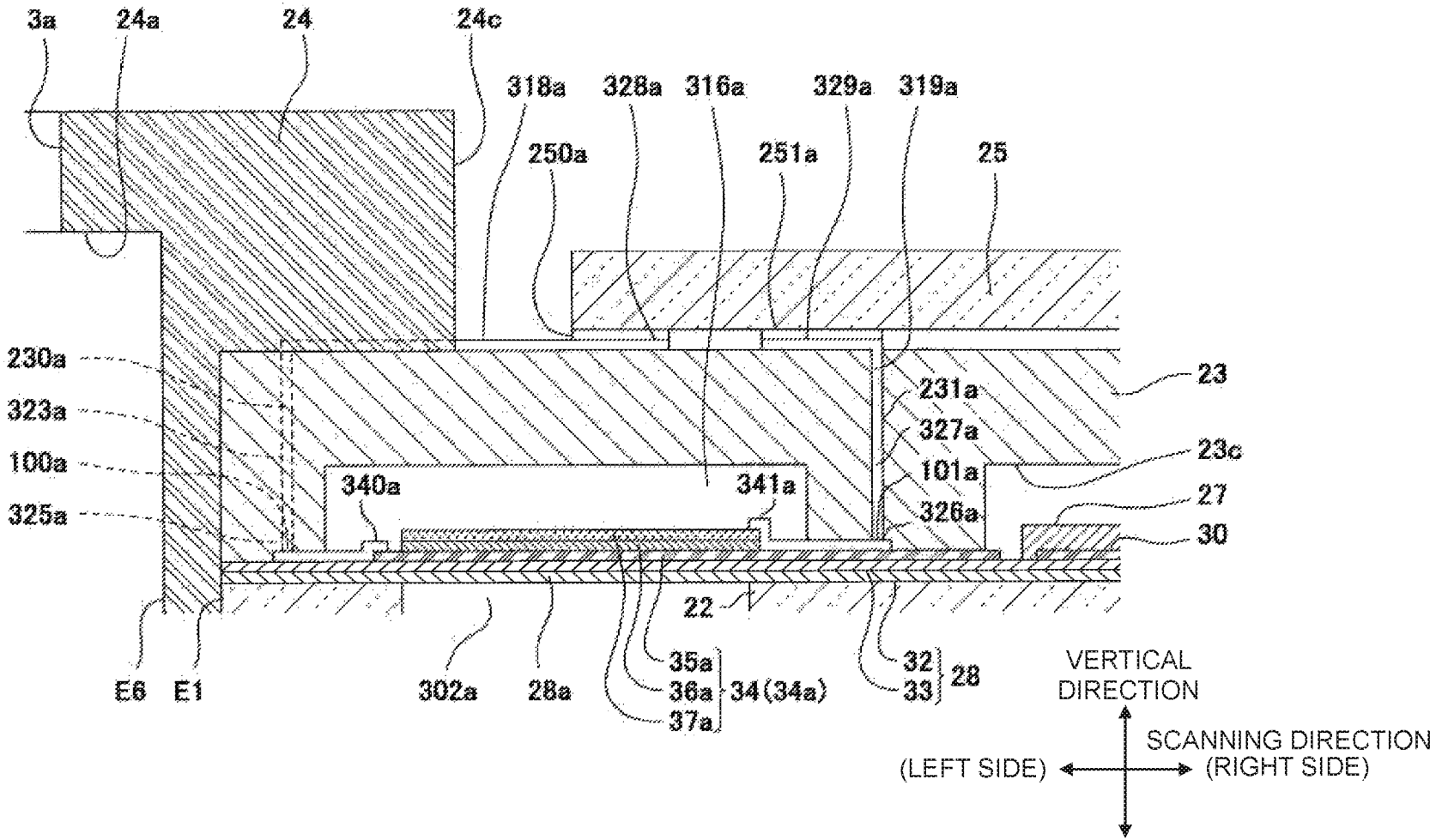
FIG. 5 is a cross-sectional view of the ink jet head of FIG. 2 along the line V-V.
Figure 6:
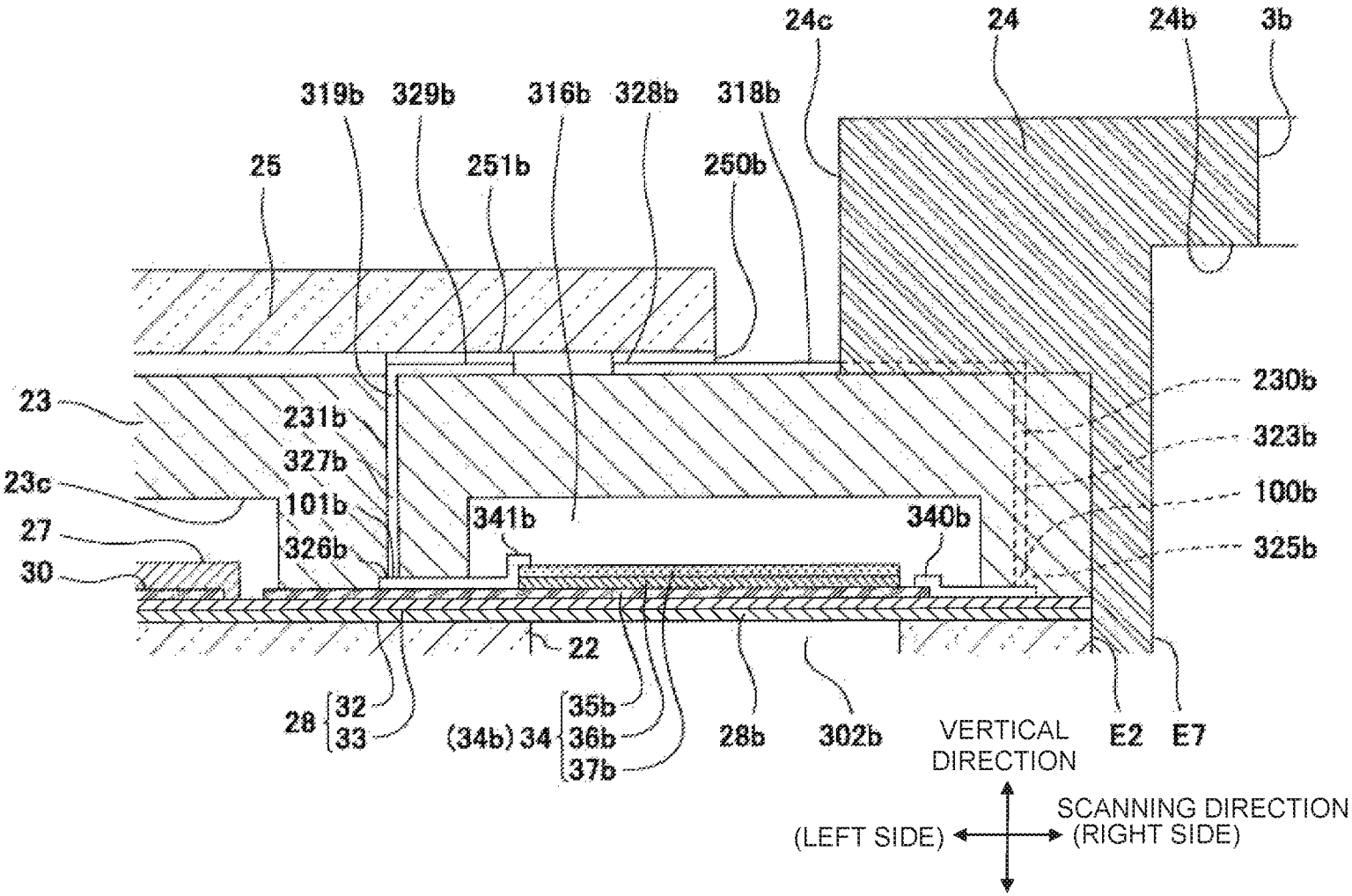
FIG. 6 is a cross-sectional view of the ink jet head of FIG. 2 along the line VI-VI.
Figure 7:
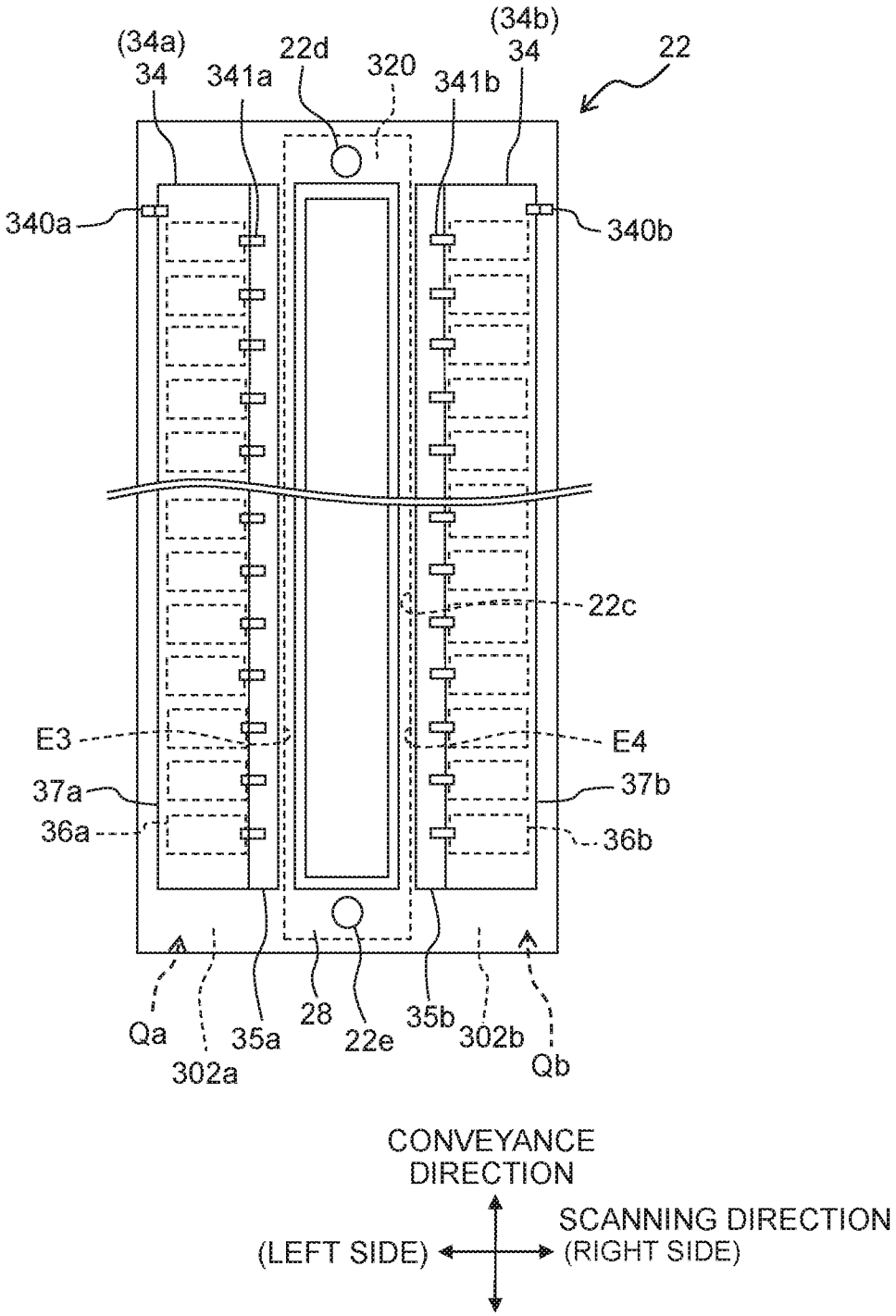
FIG. 7 is a plan view of a substrate of FIG. 4.

Referring to FIGS. 2-10, the ink jet head 3 of the present teaching will be explained. In FIGS. 5 and 6, a partial structure of wires 318*a* and 318*b* is depicted with broken lines. FIG. 7 depicts a surface, of a substrate 22, provided with the piezoelectric elements 34*a* and 34*b* and depicts positions of pressure chambers 302*a*, pressure chambers 302*b* and a channel 320 with broken lines. A direction perpendicular to the page of FIG. 7 is a vertical direction which will be described later on.

As depicted in FIGS. 2 to 4 and 8, the ink jet head 3 includes a nozzle substrate 20, a substrate 21, the substrate 22, a substrate 23, a channel member 24, an IC 25, damper films 26 and 27, a vibration plate 28, a support member 17, 400 films 29, a film 30, and the total of 800 piezoelectric elements 34*a* and 34*b*. The nozzle substrate 20, the substrate 21, the substrate 22, the substrate 23, and the IC 25 are arranged upwardly (in a direction away from the platen 4 along the thickness direction of the platen 4) in the above order to overlap with each other.

The ink jet head 3 is constructed by combining the nozzle substrate 20, the substrates 21 to 23, and the channel member 24. The ink jet head 3 is formed internally with the channel 300*a*, the channel 300*b*, the channel 320,400 communication channels 304*a*, 400 communication channels 304*b*, 400 pressure chambers 302*a*, 400 pressure chambers 302*b*, an operation space 316*a*, an operation space 316*b*, and a displacement space 321.

As depicted in FIG. 3, the channel 300*a* and the channel 300*b* are arranged at the two opposite sides of the ink jet head 3 in the scanning direction to interpose the channel 320. The channel 300*a* and the channel 300*b* are arranged to extend in the conveyance direction along the surface of the substrate 21, at an interval along the scanning direction.

The pressure chambers 302*a* and the communication channels 304*a* are arranged between the channel 300*a* and the channel 320, and the pressure chambers 302*b* and the communication channels 304*b* are arranged between the channel 300*b* and the channel 320. The channel 300*a* is connected to the channel 320 via the pressure chambers 302*a* and the communication channels 304*a*. The channel 300*b* is connected to the channel 320 via the pressure chambers 302*b* and the communication channels 304*b*. In the ink jet head 3, the ink flows from the channel 300*a* and the channel 300*b* toward the channel 320.

In particular, the nozzle substrate 20 is arranged to superimpose the surface of the substrate 21 at the side of the platen 4. The nozzle substrate 20 is, for example, formed of a silicon single crystal, a metal, or a resin. The nozzle substrate 20 is formed with the 400 nozzles 20*a* and the 400 nozzles 20*b*. The 400 nozzles 20*a* and the 400 nozzles 20*b* are formed to penetrate through the nozzle substrate 20 in the thickness direction. The 400 nozzles 20*a* align in the conveyance direction and the 400 nozzles 20*b* also align in the conveyance direction. The 400 nozzles 20*a* and the 400 nozzles 20*b* align in the scanning direction.

Between the nozzle substrate 20 and the substrate 22, the 400 communication channels 304*a* are formed to let the ink flow toward the channel 320 after passing through the pressure chambers 302*a*, while the 400 communication channels 304*b* are formed to let the ink flow toward the channel 320 after passing through the pressure chambers 302*b*. In this embodiment, the 400 communication channels 304*a* and the 400 communication channels 304*b* are formed between the nozzle substrate 20 and the substrate 21.

The 400 nozzles 20*a* are formed in midstream on the respective communication channels 304*a* to correspond individually to the 400 pressure chambers 302*a* and the 400 communication channels 304*a*. The respective communication channels 304*a* extend in the scanning direction to let the ink flow toward the channel 320 after passing through the corresponding pressure chambers 302*a*. The 400 nozzles 20*b* are formed in midstream on the respective communication channels 304*b* to correspond individually to the 400 pressure chambers 302*b* and the 400 communication channels 304*b*. The respective communication channels 304*b* extend in the scanning direction to let the ink flow toward the channel 320 after passing through the corresponding pressure chambers 302*b*.

Note that the respective nozzles 20*a* may be arranged to overlap with the corresponding pressure chambers 302*a* along the vertical direction orthogonal to the conveyance direction and to the scanning direction. Further, the respective nozzles 20*b* may be arranged to overlap with the pressure chambers 302*b* along the vertical direction.

As depicted in FIG. 3, the substrate 21 defines the channel 300*a* and the channel 300*b*. The substrate 21 may include a substrate 19 stacked on the surface of the substrate 21 at the other side than where the vibration plate 28 is arranged. The substrate 19 may be formed of silicon, for example. The substrate 19 may define at least part of the channel 300*a* and at least part of the channel 300*b*, respectively. The substrate 21 is sized larger than the nozzle substrate 20 along the scanning direction. The two opposite ends of the substrate 21 along the scanning direction extend from the two opposite ends of the nozzle substrate 20 toward the opposite side from the channel 320.

The channel 300a is arranged at the left side of the nozzle substrate 20 while the channel 300b is arranged at the right side of the nozzle substrate 20. The channel 300a is arranged at the left side of two aftermentioned pressure chamber rows Qa and Qb while the channel 300b is arranged at the right side of the two pressure chamber rows Qa and Qb. The channel 300a is a common channel extending along the conveyance direction and in communication with the 400 pressure chambers 302a. The channel 300b is a common channel extending along the conveyance direction and in communication with the 400 pressure chambers 302b.

The substrate 22 is arranged to superimpose the surface of the substrate 21 at the other side than the nozzle substrate 20. The substrate 22 has a surface parallel to the conveyance direction and to the scanning direction. The substrate 22 is formed of silicon, for example. The substrate 22 is formed with the 400 pressure chambers 302a, the 400 pressure chambers 302b, and a space 22c constituting at least part of the channel 320. Further, the substrate 22 is provided with the 400 piezoelectric elements 34a and the 400 piezoelectric elements 34b.

As depicted in FIGS. 4 and 7, the 400 pressure chambers 302a align along the conveyance direction, as viewed from the vertical direction, between the channel 300a and the channel 300b. The 400 pressure chambers 302b are arranged apart from the 400 pressure chambers 302a in the scanning direction to align in the conveyance direction. By virtue of this, the two pressure chamber rows Qa and Qb are formed.

The ink having passed through the channel 300a flows into the respective pressure chambers 302a forming the pressure chamber row Qa while the ink having passed through the channel 300b flows into the respective pressure chambers 302b forming the pressure chamber row Qb.

The channel 320 is arranged between the two pressure chamber rows Qa and Qb to extend in the conveyance direction. The ink having passed through the respective pressure chambers 302a and 302b flows into the channel 320. The channel 320 is formed by cutting in the substrate 22. The channel 320 extends along the conveyance direction. The channel 320 is a common channel in communication with the 400 pressure chambers 302a and the 400 pressure chambers 302b. The respective piezoelectric elements 34a apply jet pressure to the ink inside the pressure chambers 302a while the respective piezoelectric elements 34b apply jet pressure to the ink inside the pressure chambers 302b.

As depicted in FIG. 4, a channel 301a is provided between the channel 300a and the respective pressure chamber 302a to extend in the scanning direction. An opening 311a of the channel 301a at the side of the channel 300a is defined by a surface 210 of the substrate 21 at the side of the channel member 24 and a side surface 240a of the channel member 24 at the aftermentioned end E6. An opening 312a of the channel 301a at the side of the channel 320 is defined by a surface 221 of the substrate 22 at the side of the substrate 20 and the surface 210 of the substrate 21.

Further, a channel 303a is formed between the respective pressure chambers 302a and the corresponding communication channels 304a to extend in the vertical direction. An opening 313a of the channel 303a at the side of the substrate 22 is defined by the surface 210 of the substrate 21, and an opening 314a of the channel 303a at the side of the nozzle substrate 20 is defined by a surface 211 of the substrate 21 at the side of the nozzle substrate 20.

Further, the opening 314a is connected with an opening 317a of the corresponding communication channels 304a at the side of the pressure chamber 302a. The surface 211 of the substrate 21 defines the opening 317a. An opening 315a of the communication channels 304a at the side of the channel 320 is defined by a side surface 210a of the substrate 21 at the side of the channel 320, and a surface 201 of the nozzle substrate 20 at the side of the substrate 21.

Further, as depicted in FIG. 4, a channel 301b is provided between the channel 300b and the respective pressure chamber 302b to extend in the scanning direction. An opening 311b of the channel 301b at the side of the channel 300b is defined by the surface 210 of the substrate 21 and a side surface 240b of the channel member 24 at the aftermentioned end E7. An opening 312b of the channel 301b at the side of the channel 320 is defined by the surface 221 of the substrate 22 and the surface 210 of the substrate 21.

Further, a channel 303b is formed between the respective pressure chambers 302b and the corresponding communication channels 304b to extend in the vertical direction. An opening 313b of the channel 303b at the side of the substrate 22 is defined by the surface 210 of the substrate 21, and an opening 314b of the channel 303b at the side of the nozzle substrate 20 is defined by the surface 211 of the substrate 21 at the side of the nozzle substrate 20.

Further, the opening 314b is connected with an opening 317b of the corresponding communication channels 304b at the side of the pressure chamber 302b. The surface 211 of the substrate 21 defines the opening 317b. An opening 315b of the communication channels 304b at the side of the channel 320 is defined by a side surface 210b of the substrate 21 at the side of the channel 320, and the surface 201 of the nozzle substrate 20 at the side of the substrate 21.

Here, because the channels 301a and 303a and the communication channels 304a are smaller than the pressure chambers 302a in terms of channel cross-sectional area, they are larger than the pressure chambers 302a in terms of channel resistance. Likewise, because the channels 301b and 303b and the communication channels 304b are smaller than the pressure chambers 302b in terms of channel cross-sectional area, they are larger than the pressure chambers 302b in terms of channel resistance.

As depicted in FIGS. 2, 3 and 7, supply ports 3a and 3b and discharge ports 3c and 3d are formed in the channel member 24. At the upstream side of the substrate 22 along the conveyance direction, a through hole 22d is formed to penetrate therethrough in the thickness direction. The through hole 22d is in communication with the discharge port 3c and the channel 320 formed in the channel member 24. At the downstream side of the substrate 22 along the conveyance direction, a through hole 22e is formed to penetrate therethrough in the thickness direction. The through hole 22e is in communication with the discharge port 3d and the channel 320 formed in the channel member 24.

As depicted in FIG. 4, in the ink jet head 3, one channel 301a one pressure chamber 302a, one channel 303a, and one communication channel 304a are formed to correspond to one nozzle 20a, Further, one channel 301b, one pressure chamber 302b, one channel 303b, and one communication channel 304b are formed to correspond to one nozzle 20b.

As depicted in FIGS. 4 to 6, the substrate 22 is further provided with a vibration plate 28. The vibration plate 28 transmits the vibration generated by the respective piezoelectric elements 34a to the ink inside the corresponding pressure chambers 302a, and transmits the vibration generated by the respective piezoelectric elements 34b to the ink inside the corresponding pressure chambers 302*b*. It is possible to set the vibration plate 28 at an appropriate thickness which may be, for example, of a value not less than 1.5 μm and not more than 2.0 μm.

The vibration plate 28 blocks the upper surfaces of the 400 pressure chambers 302*a* and the 400 pressure chambers 302*b*. The vibration plate 28 includes elastic layers 32 and 33. The elastic layers 32 and 33 are formed of an inorganic material. The vibration plate 28 has 400 parts 28*a* overlapping with the 400 piezoelectric elements 34*a* and 400 parts 28*b* overlapping with the 400 piezoelectric elements 34*b*.

The elastic layer 32 is arranged on the surface of the substrate 22 at the other side than the nozzle substrate 20. The elastic layer 33 overlaps with the surface of the elastic layer 32. The vibration plate 28 is formed of a metallic oxide. For example, the elastic layer 32 is formed of $SiO_2$ (silicon dioxide). For example, the elastic layer 33 is formed of $ZrO_2$ (zirconium dioxide). The substrate 22 supports the piezoelectric elements 34*a* and 34*b* via the vibration plate 28.

The space 22*c* is arranged between the 400 pressure chambers 302*a* and the 400 pressure chambers 302*b* along the scanning direction, and extends along the conveyance direction. By virtue of this, at least part of the channel 320 (the upper part of the channel 320 in this embodiment) is positioned between the pressure chambers 302*a* and 302*b*.

Note that the channel 320 may have at least one of a part overlapping with the pressure chambers 302*a* along the vertical direction and a part overlapping with the pressure chambers 302*b* along the vertical direction. Further, the channel 320 may have at least one of a part overlapping with somewhere between the pressure chambers 302*a* and the channels 300*a* along the vertical direction and a part overlapping with somewhere between the pressure chambers 302*b* and the channels 300*b* along the vertical direction.

The substrate 23 is a wiring member connecting the total of 800 piezoelectric elements 34*a* and 34*b* and the IC 25. The substrate 23 has one wire 318*a*, one wire 318*b*, 400 wires 319*a*, and 400 wires 319*b*.

The substrate 23 in this embodiment has a surface S1 mounted with the IC 25, and a surface S2 at the other side than the surface S1. As depicted in FIGS. 4 to 6, the substrate 23 has, in particular, one through hole 230*a*, one through hole 230*b*, 400 through holes 231*a*, and 400 through holes 231*b*. Each of the through holes 230*a*, 230*b*, 231*a* and 231*b* penetrates through the substrate 23 from the surface S1 to the surface S2. The wire 318*a* is inserted in the through hole 230*a*, while the wire 318*b* is inserted in the through hole 230*b*. One wire 319*a* is inserted in each of the through holes 231*a*, while one wire 319*b* is inserted in each of the through holes 231*b*.

The wire 318*a* has a part 323*a* formed in the through hole 230*a*, a terminal 325*a* provided in a part facing the substrate 22, and a terminal 328*a* provided in a part facing the IC 25. The wires 319*a*. has a part 327*a* formed in the through holes 231*a*, a terminal 326*a* provided in a part facing the substrate 22, and a terminal 329*a* provided in a part facing the IC 25.

The wire 318*b* has a part 323*b* formed in the through hole 230*b*, a terminal 325*b* provided in a part facing the substrate 22, and a terminal 328*b* provided in a part facing the IC 25. The wires 319*b* has a part 327*b* formed in the through holes 231*b*, a terminal 326*b* provided in a part facing the substrate 22, and a terminal 329*b* provided in a part facing the IC 25. Each of the terminals 325*a*, 324*b*, 326*a* and 326*b* is formed on the surface of the substrate 22 at the other side than the nozzle substrate 20.

The parts 323*a* and 323*b* are pass-through electrode parts of the wires 318*a* and 318*b*, while the parts 327*a* and 327*b* are pass-through electrode parts of the wires 319*a* and 319*b*. Further, the surface S2 is formed with a recess 23*c* facing the damper film 27 along the vertical direction. Because the recess 23*c* is formed, the substrate 23 will not hinder the damper film 27 from deforming.

The substrate 23 is arranged to cover the piezoelectric elements 34*a* and 34*b* and the damper film 27. The substrate 23 is formed of, for example, silicon. The substrate 23 is formed with operation spaces 316*a* and 316*b* for the piezoelectric elements 34*a* and 34*b*, and a displacement space 321 for the damper film 27. The operation spaces 316*a* and 316*b* are formed in positions overlapping with the piezoelectric elements 34*a* and 34*b* while the displacement space 321 is formed in a position overlapping with the damper film 27.

The channel member 24 covers the periphery of the substrate 23 with the surface of the substrate 23 being exposed at the other side than the nozzle substrate 20. The channel member 24 is formed of, for example, a metal, a resin, or the like. The channel member 24 is formed with a through hole 24*c* penetrating therethrough along the vertical direction. The substrate 23 exposes its surface at the other side than the nozzle substrate 20 from the through hole 24*c*. The channel member 24 is combined with the substrate 21 on the outside of the substrate 23 in the scanning direction.

As depicted in FIG. 4, the substrate 21 is formed with two through holes 21*a* and 21*b* penetrating therethrough along the thickness direction. Two recesses 24*a* and 24*b* are formed in the surface of the channel member 24 facing the substrate 21. The through hole 21*a* and the recess 24*a* overlap in the vertical direction to form the channel 300*a* while the through hole 21*b* and the recess 24*b* overlap in the vertical direction to form the channel 300*b*. The channel 300*a* and the channel 300*b* extend respectively in the conveyance direction to interpose the channel 320 along the scanning direction.

The substrate 22 has the end E1 and the end E2 as its two ends in the scanning direction. The substrate 21 has the end E9 and the end E10 as its two ends in the scanning direction. The channel 300*a* has the end E5 and the end E6 as its two ends in the scanning direction. The channel 300*b* has the end E7 and the end E8 as its two ends in the scanning direction.

The ends E5 to E8 in this embodiment are arranged in the order of the end E5, the end E6, the end E7, and the end. E8, along the scanning direction from the end E9 toward the end E10. The distance D1 from the end E1 to the end E2 along the scanning direction is smaller than the distance D2 from the end E5 to the end E8 along the scanning direction.

The IC 25 is a driver IC driving the total of 800 piezoelectric elements 34*a* and 34*b*. The IC 25 is arranged inside the through hole 24*c* along the surface of the substrate 23 at the other side than the nozzle substrate 20. As depicted in FIGS. 4 to 6, the IC 25 has terminals 250*a*, 250*b*, 251*a*, and 251*b*.

One end of the wire 318*a* extends along the upper surface of the substrate 23, and a terminal 328*a* thereof is connected with the terminal 250*a* of the IC 25. The other end of the wire 318*a* extends in the vertical direction, and a terminal 325*a* thereof is connected with the terminals 340*a* of the piezoelectric elements 34*a*. The terminals 340*a* are connected with the common electrode 35*a*.

One end of the wires 319*a* extends along the upper surface of the substrate 23, and a terminal 329*a* thereof is connected with the terminal 251*a*. of the IC 25. The other end of the wires 319*a* extends in the vertical direction, and a terminal 326*a* thereof is connected with the terminals 341*a* of the piezoelectric elements 34*a*. The terminals 341*a* are connected with the individual electrodes 37*a*.

One end of the wire 318*b* extends along the upper surface of the substrate 23 and a terminal 328*b* thereof is connected with the terminal 250*b* of the IC 25. The other end of the wire 318*b* extends in the vertical direction, and a terminal 325*b* thereof is connected with the terminals 340*b* of the piezoelectric elements 34*b*. The terminals 340*b* are connected with the common electrode 35*b*.

One end of the wires 319*b* extends along the upper surface of the substrate 23, and a terminal 329*b* thereof is connected with the terminal 251*b* of the IC 25. The other end of the wires 319*b* extends in the vertical direction, and a terminal 326*b* thereof is connected with the terminals 341*b* of the piezoelectric elements 34*b*. The terminals 341*b* are connected with the individual electrodes 37*b*.

In this manner, the IC 25 is arranged on the upper surface of the substrate 23 and connected with the total of 800 piezoelectric elements 34*a* and 34*b* through the wires 318*a*, 318*b*, 319*a* and 319*b*. Therefore, members such as a flexible substrate and the like are not needed for connecting, for example, the piezoelectric elements 34*a* and 34*b* with the IC 25.

Here, the respective pressure chambers 302*a*, and the respective terminals 341*a* of the corresponding piezoelectric elements 34*a* are arranged between the end E1 and the space 22*c* along the scanning direction. Further, the respective pressure chambers 302*b*, and the respective terminals 341*b* of the corresponding piezoelectric elements 34*b* are arranged between the end E2 and the space 22*c* along the scanning direction.

In this embodiment, the respective terminals 341*a* are arranged between the 400 pressure chambers 302*a* and the space 22*c* along the scanning direction. Further, the respective terminals 340*b* are arranged between the 400 pressure chambers 302*b* and the space 22*c* along the scanning direction. Further, the respective terminals 341*a* and 341*b* may be arranged in positions overlapping with aftermentioned piezoelectric layers 36*a* and 36*b*.

As depicted in FIG. 4, the damper film 26 is provided on the substrate 21 to block the through hole 21*a* and the through hole 21*b* of the substrate 21. The damper film 26 absorbs the vibration of the ink inside the channel 300*a* and the channel 300*b*. The damper film 26 is a thin film made of polyphenylene sulfide (PPS) or stainless steel. For example, the damper film 26 is provided on the lower surface of the substrate 21.

The damper film 27 is provided on the substrate 22 to block an opening 220 of the substrate 22. The damper film 27 absorbs the vibration of the ink inside the channel 320. The damper film 27 is arranged on the upper surface of the substrate 22. The damper film 27 defines the space 22*c* at the side of the upper surface of the substrate 22. The damper film 27 restrains the ink flowing through the channel 320 from moving on the upper surface of the substrate 22 via the space 22*c*. As depicted in FIGS. 3 and 7, the damper film 27 has, for example, a rectangular contour with the conveyance direction as its longitudinal direction.

The damper film 27 in this embodiment is formed of a different material from the damper film 26. The damper film 27 is formed of a resin material. For example, the damper film 27 is formed of photoresist. Since the damper film 27 is formed of photoresist, it is possible to easily pattern the damper film 27 and/or to easily set a thickness for the same.

The damper film 27 is lower in elastic modulus than the elastic layers 32 and 33 of the vibration plate 28. Further, the damper film 27 is higher in toughness than the elastic layers 32 and 33 of the vibration plate 28. Note that the damper film 27 may be smaller in thickness than the piezoelectric layers 36*a* and 36*b*. In the ink jet head 3, the nozzle substrate 20 is arranged on the lower surface of the substrate 21. The channel 320 is defined by the substrate 22, the substrate 21, the nozzle substrate 20, the vibration plate 28, and the damper film 27.

The support member 17 is constructed from the same layer as the elastic layers 32 and 33 of the vibration plate 28. The support member 17 is interposed between the substrate 22 and the damper film 27 along the vertical direction to support the damper film 27. The support member 17 in this embodiment is formed continuous with the vibration plate 28. As depicted in FIG. 7, the support member 17 (in other words, the vibration plate 28) is formed with an opening which has a rectangular contour as viewed from the vertical direction and has a rectangular periphery on the inside. This opening is one end of the space 17*d* at the side of the substrate 23. The support member 17 may be formed discontinuous with the vibration plate 28 (in other words, separate from the vibration plate 28 in the scanning direction).

Figure 9:
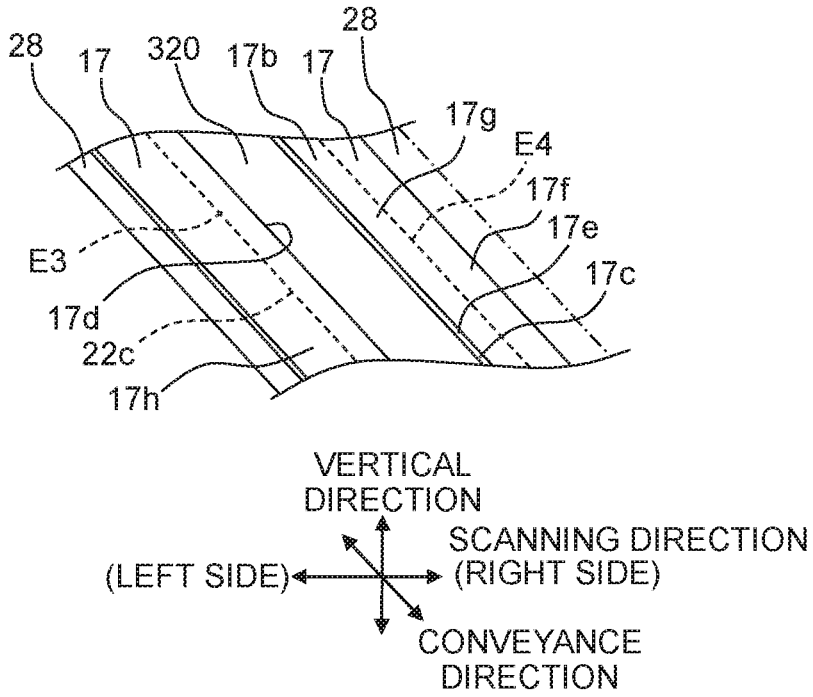
FIG. 9 is a perspective view of a support member of FIG. 4.
Figure 10:
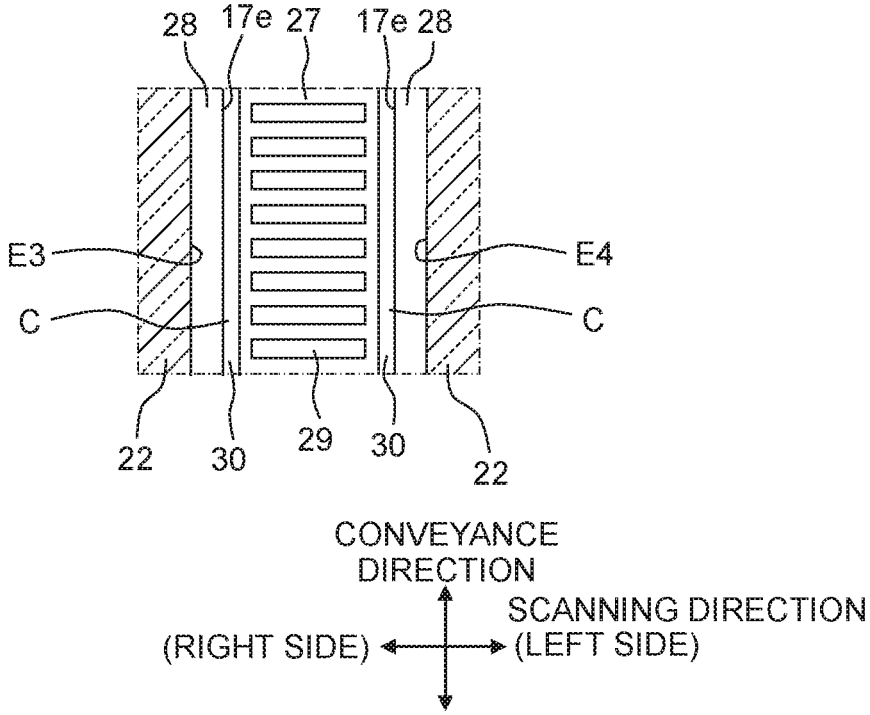
FIG. 10 is a plan view of a film of FIG. 4.

FIG. 9 has omitted the film 30 and the damper film 27. FIG. 10 depicts the surface of the damper film 27 at the side of the nozzle substrate 20.

As depicted in FIGS. 4 to 8, the space 22*c* of the substrate 22 has the end E3 and the end E4 as its two opposite ends along the scanning direction. The end E3 is arranged between the end E1 and the end E4 while the end E4 is arranged between the end E3 and the end E2. The support member 17 has a part 17*h* and a part 17*i*. The part 17*h* is arranged between the end E1 of the substrate 22 and the end E3 of the space 22*c* and between the end E2 of the substrate 22 and the end E4 of the space 22*c* along the scanning direction, and interposed between the damper film 27 and the substrate 22 along the vertical direction.

Figure 8:
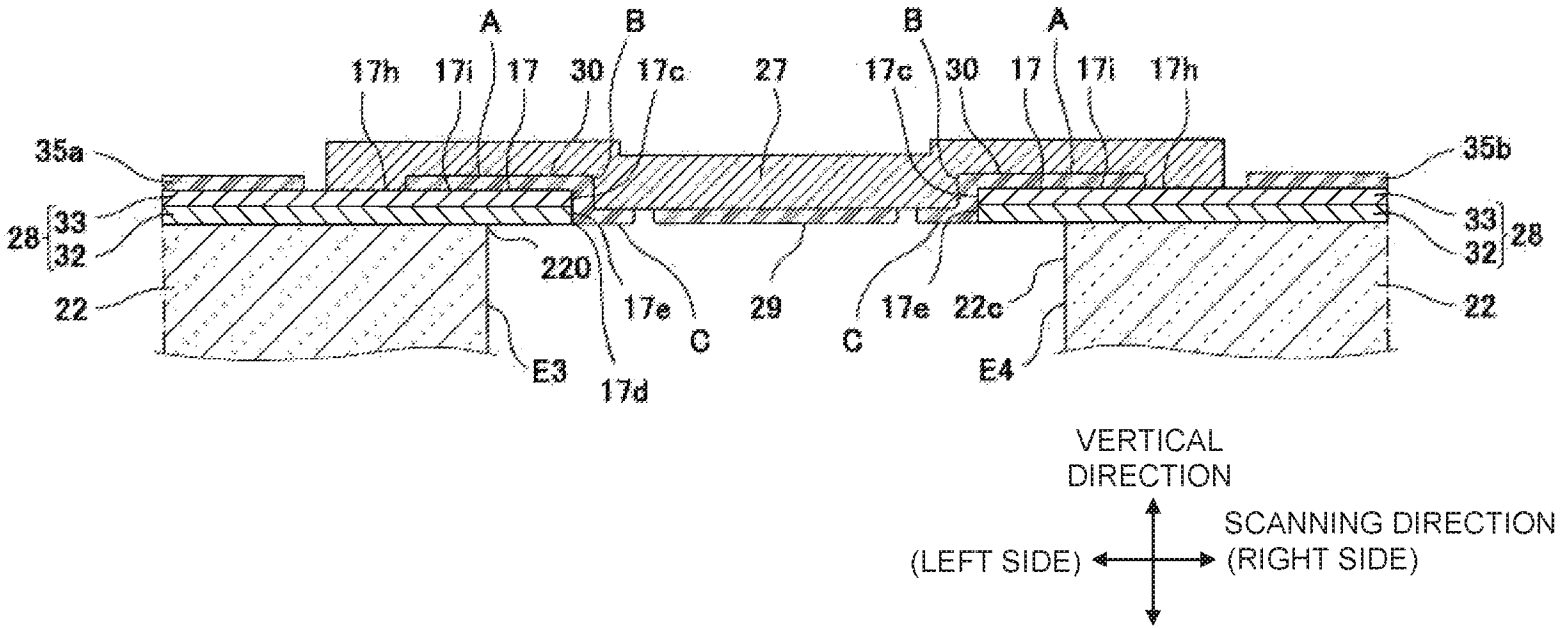
FIG. 8 is a partially enlarged view of FIG. 4.

The part 17*i* projects from the part 17*h* on the left side of the page of FIG. 8 toward the end E4 of the space 22*c*, and projects from the part 17*h* on the right side of the page of FIG. 8 toward the end E3 of the space 22*c*. The part 17*i* has a side surface 17*c* positioned between the end E3 and the end E4 of the space.

Here, the ink jet head 3 includes a space 17*d* arranged inside the space 22*c* as viewed from the vertical direction. As depicted in FIG. 9, the support member 17 further has a peripheral portion 17*e*, a ring-like portion 17*f*, and an extending portion 17*g*. The peripheral portion 17*e* defines the space 17*d*. The ring-like portion 17*f* is arranged to enclose the space 22*c* as viewed from the vertical direction. The extending portion 17*g* extends from the ring-like portion 17*f* to the peripheral portion 17*e*.

It is possible to appropriately set a length for the extending portion 17*g* from the ring-like portion 17*f* to the peripheral portion 17*e* and, for example, to set a value not less than 10 μm and not more than 50 μm. Further, the damper film 27 may be formed of the same material as the damper film 26. Further, the damper film 27 may be formed of the same material as the vibration plate 28. In such a case, it is possible to use part of the vibration plate 28 overlapping with the channel 320 as the damper film 27.

The substrate 22 is further provided with a film 30. The film 30 prevents the damper film 27 from detachment. The film 30 is formed of the same material as the electrodes (the common electrodes 35*a* and 35*b*, for example) included respectively in the total of 800 piezoelectric elements 34*a* and 34*b*.

The film 30 has parts A to C. The part A is interposed between the upper surface of the part. 17*i* and the damper film 27. The part B is interposed between the side surface 17*c* of the support member 17 and the damper film 27.

The part C projects from the part B of the support member 17 on the left side toward the end E4 of the space 22*c*, and projects from the part B of the support member 17 on the right side toward the end E3 of the space 22*c*. The part C has an end arranged between the end E3 and the end E4 of the space 22*c* along the scanning direction. The damper film 27 is superimposed by the space 17*d* of the support member 17 via the film 30 and formed to fit in the space 17*d* of the support member 17.

Further, the part C of the film 30 extends from the side surface 17*c* of the support member 17 toward the center of the space 17*d* along the scanning direction. By virtue of this, the peripheral part of the damper film 27 is supported by the film 30 in the area overlapping with the space 22*c* of the damper film 27 along the vertical direction.

Here, when viewed from the conveyance direction, the film 30 covers the side surface 17*c* of the support member 17 along a gentle curve. By virtue of this, the damper film 27 with the attached film 30 is prevented from forming edges such that damage is prevented along with the vibration of the damper film 27. Further, the damper film 27 increases in the adhesion to the film 30, thereby preventing the damper film 27 from detachment.

The film 30 is formed of the same material as the common electrodes 35*a* and 35*b*. The film 30 may be formed of the same material as the individual electrodes 37*a* and 37*b* or of a different material from the electrodes 35*a*, 35*b*, 37*a*, and 37*b*.

As depicted in FIGS. 8 and 10, the film 29 is stacked on the surface of the damper film 27 facing the space 22*c*. The film 29 is a reinforcement member for reinforcing the damper film 27. The film 29 is formed of the same material as the electrodes included respectively in the total of 800 piezoelectric elements 34*a* and 34*b*. The film 29 is arranged to overlap with the damper film 27 positioned inside the space 17*d* of the support member 17. The film 29 is made of a metal. In this embodiment, 400 films 29 are arranged on the lower surface of the damper film 27 at intervals along the conveyance direction. The 400 films 29 are arranged on the lower surface of the damper film 27 at floating-island-like intervals.

It is possible to set an appropriate thickness for the films 29, for example, smaller than the thickness of the vibration plate 28. The films 29 are set to a value of thickness, for example, not less than 100 nm and not more than 200 nm.

The films 29 are made of, for example, the same material as the aftermentioned common electrodes 35*a* and 35*b*. The films 29 may be formed of the same material as the individual electrodes 37*a* and 37*b* or of a different material from the electrodes 35*a*, 35*b*, 37*a*, and 37*b*. Further, the number of films 29 may be another than 400. Further, the films 29 are not limited to the aforementioned shape but may be, for example, a grid-like shape expanding along the surface of the damper film 27.

By driving the pumps PI to P3, the ink supplied to the supply port 3*a* from the pipe 9 is supplied to the channel 300*a* while the ink supplied to the supply port 3*b* from the pipe 9 is supplied to the channel 300*b*. The ink supplied to the channel 300*a* flows through the channels 301*a*, the pressure chambers 302*a*, the channels 303*a*, the communication channels 304*a*, and the channel 320, in the above order. The ink supplied to the channel 300*b* flows through the channels 301*b*, the pressure chambers 302*b*, the channels 303*b*, the communication channels 304*b*, and the channel 320, in the above order. Part of the ink flowing through the communication channels 304*a* and 304*b* are jetted from the nozzles 20*a* and 20*b*.

Further, by driving the pumps P1 to P3, the ink passing through the channel 320 is discharged from the discharge ports 3*c* and 3*d* to the pipe 9. The ink discharged to the pipe 9 is returned to the negative pressure tank 12 through the pipe 9, and resupplied from the supply ports 3*a* and 3*b* to the channels 300*a* and 300*b*. By virtue of this, the ink circulates between the ink jet head 3 and the tanks 11 and 12.

Here, in order to jet the ink from the nozzles 20*a* and 20*b*, the vibration of the piezoelectric elements 34*a* and 34*b* is transmitted to the ink flowing through the pressure chambers 302*a* and 302*b*. This vibration may also be transmitted to the ink flowing through the respective channels 300*a*, 300*b* and 320, etc.

In regard to this aspect, in the ink jet head 3 according to this embodiment, the vibration transmitted to the ink flowing through the channel 300*a* and the channel 300*b* is absorbed with the damper film 26 undergoing elastic deformation along the vertical direction. Further, the vibration transmitted to the ink flowing through the channel 320 is absorbed with the damper film 27 undergoing elastic deformation along the vertical direction. With the damper film 26 and the damper film 27 deforming in this manner, the ink flowing inside the ink jet head 3 is restrained from pressure variation.

<Piezoelectric Elements>

As depicted in FIGS. 4 to 7, an actuator 34 is provided on the upper surface of the substrate 22. The actuator 34 is constructed from the total of two piezoelectric layers 36*a* and 36*b*, the total of two common electrodes 35*a* and 35*b*, the total of 800 individual electrodes 37*a* and 37*b*, and the one vibration plate 28.

The piezoelectric layers 36*a* and 36*b* expand in the conveyance direction and the scanning direction. The piezoelectric layers 36*a* and 36*b* are made of a piezoelectric material. The piezoelectric material may take, for example, lead zirconate titanate (PLT) as its primary material. The piezoelectric layers 36*a* and 36*b* are arranged in positions overlapping with the pressure chambers 302*a* and 302*b* of the substrate 22.

Further, the piezoelectric layers 36*a* and 36*b* may be constructed of two or more layers arranged to overlap with each other. These layers may include a layer(s) made of a piezoelectric material and a layer(s) made of another material than the piezoelectric material (for example, an insulating material such as a synthetic resin material or the like).

The common electrodes 35*a* and 35*b* are arranged between the vibration plate 28 and the piezoelectric layers 36*a* and 36*b*, to extend continuously across almost the entire area of the piezoelectric layers 36*a* and 36*b*. The common electrodes 35*a* and 35*b* are arranged at a distance from the film 30 along the scanning direction. The common electrodes 35*a* and 35*b* are maintained at the ground potential.

The individual electrodes 37*a* and 37*b* are arranged to overlap with the piezoelectric layers 36*a* and 36*b* and provided individually for the respective pressure chambers 302*a* and 302*b*. The common electrodes 35*a* and 35*b* and the individual electrodes 37*a* and 37*b* are made of a metallic material with a good conductivity such as platinum (Pt) or iridium (Ir). An insulating layer is arranged appropriately between the common electrodes 35*a* and 35*b* and the individual electrodes 37*a* and 37*b* to facilitate insulation.

As depicted in FIGS. 3, 4, and 7, when viewed from the vertical direction, the piezoelectric layers 36*a* and 36*b* and the common electrodes 35*a* and 35*b* have a belt-like plane shape with the conveyance direction as the longitudinal direction and with the scanning direction as the width direction. The common electrodes 35*a* and 35*b* are arranged at the two opposite sides of the damper film 27 along the scanning direction. Ends of the common electrodes 35*a* and 35*b* at one side along the scanning direction extend to a position as far as not to overlap with the pressure chambers 302*a* and 302*b*, and connect with the terminals 340*a* and 340*b* for connection with the IC 25.

The terminal 340*a* is connected with a terminal 325*a* of the wire 318*a* at a contact point 100*a* while the terminal 340*b* is connected with a terminal 325*b* of the wire 318*b* at a contact point 100. The contact points 100*a* and 100*b* are arranged not to overlap with the space 22*c* and the damper film 27 along the vertical direction, respectively.

When viewed from the vertical direction, the individual electrodes 37*a* and 37*b* have an approximately rectangular plane shape with the conveyance direction as the width direction and with the scanning direction as the longitudinal direction. The individual electrodes 37*a* and 37*b* are arranged to overlap with central portions of the corresponding pressure chambers 302*a* and 302*b*. The individual electrodes 37*a* and 37*b* have such ends on one side along the scanning direction as to extend to positions as far as not to overlap with the pressure chambers 302*a* and 302*b*, and connect with the terminals 341*a* and 341*b* for connection with the IC 25.

The terminal 341*a* is connected with a terminal 326*a* of the wire 319*a* at a contact point 101*a*, while the terminal 340*b* is connected with a terminal 326*b* of the wire 319*b* at a contact point 101*b*. The contact points 101*a* and 101*b* are arranged not to overlap with the space 22*c* and the damper film 27 along the vertical direction, respectively.

The individual electrodes 37*a* and 37*b* are individually set by the IC 25 to either the ground potential or a predetermined drive potential (20 V or so, for example). The common electrodes 35*a* and 35*b*, the individual electrodes 37*a* and 37*b*, and the respective parts of the piezoelectric layers 36*a* and 36*b* interposed between the individual electrodes 37*a* and 37*b* and the common electrodes 35*a* and 35*b* constitute the total of 800 piezoelectric elements 34*a* and 34*b*. The piezoelectric elements 34*a* and 34*b* function as active portions of the actuator 34 being polarized in the vertical direction.

The piezoelectric elements 34*a* and 34*b* apply a jet pressure to the ink in the pressure chambers 302*a* and 302*b* to jet the ink from the nozzles 20*a* and 20*b*. As depicted in FIG. 4, in the ink jet head 3, the total of 800 piezoelectric elements 34*a* and 34*b* are provided to correspond respectively to the total of 800 nozzles 20*a* and 20*b*. The total of 800 piezoelectric elements 34*a* and 34*b* are formed respectively to overlap with the vibration plate 28.

In particular, the piezoelectric elements 34*a* have the piezoelectric layer 36*a*, the common electrode 35*a* connected to one surface of the piezoelectric layer 36*a*, and the individual electrodes 37*a* connected to the other surface of the piezoelectric layer 36*a*. The piezoelectric elements 34*b* have the piezoelectric layer 36*b*, the common electrode 35*b* connected to one surface of the piezoelectric layer 36*b*, and the individual electrodes 37*b* connected to the other surface of the piezoelectric layer 36*b*. The common electrodes 35*a* and 35*b* and the individual electrodes 37*a* and 37*b* include metallic electrodes extending along the surface of the vibration plate 28. The metallic electrodes are the individual electrodes 37*a* and 37*b* in this embodiment.

When the piezoelectric elements 34*a* and 34*b* do not cause the ink to be jetted from the nozzles 20*a* and 20*b* (in a standby state), all of the individual electrodes 37*a* and 37*b* are maintained at the same ground potential as the common electrodes 35*a* and 35*b*. Further, when the piezoelectric elements 34*a* and 34*b* cause the ink to be jetted from certain nozzles 20*a* and 20*b*, the individual electrodes 37*a* and 37*b* (the two individual electrodes 37*a* and 37*b* in the two piezoelectric elements 34*a* and 34*b* depicted in FIG. 4) corresponding to the pressure chambers 302*a* and 302*b* connected to the certain nozzles 20*a* and 20*b* are switched to the predetermined drive potential.

Thereafter, an electric field parallel to the polarization direction is generated in the two active portions corresponding to the above individual electrodes 37*a* and 37*b*, such that the above piezoelectric elements 34*a* and 34*b* contract in a direction perpendicular to the polarization direction. By virtue of this, in the piezoelectric elements 34*a* and 34*b*, the parts overlapping with the pressure chambers 302*a* and 302*b* of the piezoelectric layers 36*a* and 36*b* along the vertical direction deform as a whole to project toward the pressure chambers 302*a* and 302*b*. As a result, the volumes of the pressure chambers 302*a* and 302*b* decrease such that the ink pressure in the pressure chambers 302*a* and 302*b* increases, thereby jetting the ink from the certain nozzles 20*a* and 20*b*. After the ink is jetted, the potential of the above individual electrodes 37*a* and 37*h* returns to the ground potential. By virtue of this, the piezoelectric layers 36*a* and 36*b* are restored to the state before the deformation.

As explained earlier on, according to the ink jet head 3, the damper film 27 blocks the opening 220 of the space 22*c* constituting at least part of the channel 320 at the side of the upper surface of the substrate 22. Hence, it is possible to improve the effect of absorbing the vibration of the ink inside the channel 320 in communication with the 400 pressure chambers 302*a* aligned in the conveyance direction, and with the 400 pressure chambers 302*b* aligned in the conveyance direction.

Further, in the ink jet head 3, the damper film 26 and the damper film 27 are provided as the damper films absorbing the ink vibration. Therefore, it is possible to increase the contact area of the damper film 26 and damper film 27 with the ink so as to improve the effect of absorbing the vibration transmitted to the ink. Further, because the damper film 27 is provided to absorb the vibration of the ink flowing through the channel 320 between the channel 300*a* and the channel 300*b*, it is possible to prevent the ink jet head 3 from increasing in the width in the scanning direction.

Further, because part of the channels 300*a* and 300*b* is formed in the other substrate 21 than the substrate 22 while the damper film 26 is provided on the substrate 21, it is possible to prevent the substrate 22 from decreasing in yield ratio. Hence, it is possible to suppress the production cost of the ink jet head 3. Further, by forming the damper film 27 of a resin material, it is possible to further improve the effect of absorbing the vibration of the ink flowing through the channel 320.

The substrate 22 supports the total of 800 piezoelectric elements 34*a* and 34*b* via the vibration plate 28. The channel 320 is formed by cutting in the substrate 22. The damper film 27 is arranged to superimpose the upper surface of the vibration plate 28. Therefore, it is possible to arrange the total of 800 piezoelectric elements 34*a* and 34*b* and the damper film 27 in a compact manner, thereby facilitating conservation of the space for arranging the channel 320.

Further, because the ink jet head 3 is provided with the IC 25 arranged on the substrate 23 to drive the total of 800 piezoelectric elements 34*a* and 34*b*, it is possible to preferably restrain the ink jet head 3 from upsizing along the vertical direction.

Further, because the damper film 27 is arranged to superimpose the upper surface of the support member 17 to cover the space 17*d*, it is possible to preferably absorb the ink vibration in the channel 320 through the space 17*d*. Further, it is possible for the support member 17 to reliably support the damper film 27.

Further, the extending portion 17*g* of the support member 17 projects toward the center of the space 22*c* along the scanning direction beyond the ends E3 and E4 of the space 22*c* of the substrate 22, and the damper film 27 is supported by the extending portion 17*g* of the support member 17. Therefore, it is possible to lessen the flexure of the contact part of the damper film 27 with the support member 17. Hence, it is possible to relieve the stress from concentration on the contact part of the damper film 27 with the support member 17. Therefore, it is possible to stabilize the damper film 27 with the support member 17 while preventing the damper film 27 from damage.

Further, the damper film 27 is arranged to overlap with the support member 17 via the film 30 and formed to fit in the space 17*d* of the support member 17. Therefore, it is possible to preferably support the damper film 27 with the support member 17 while protecting the damper film 27 with the film 30 from the peripheral portion 17*e* of the support member 17.

Further, the film 30 is formed of the same material as the electrodes included respectively in the total of 800 piezoelectric elements 34*a* and 34*b*. Therefore, it is possible, in manufacturing, to form the electrodes and the film 30 with the same material at a low cost, while forming the electrodes and the film 30 effectively in the same process.

Further, the ink jet head 3 is provided with the film 29 being a reinforcing member. It is possible to stably use the damper film 27 for a long period of time due to the reinforcement of the damper film 27 with the film 29.

Further, the film 29 is formed of the same material as the electrodes included respectively in the total of 800 piezoelectric elements 34*a* and 34*b*. Therefore, it is possible, in manufacturing, to form the electrodes and the film 29 with the same material at a low cost, while forming the electrodes and the film 29 effectively in the same process.

Further, when the electrodes included respectively in the total of 800 piezoelectric elements 34*a* and 34*b* are formed of a metal such as Pt, Ir or the like, by forming the film 29 of the same material as the electrodes, it becomes easy to adjust the same to a small thickness. By virtue of this, if the film 29 is provided, then it is possible for the effect of absorbing the vibration by the damper film 27 to be less easily diminished by the rigidity of the film 29.

Further, by forming the film 29 on the surface of the damper film 27, in wet-etching a silicon (Si) substrate 122 for forming the substrate 22 (see FIGS. 11D and 12B), it is possible to protect the damper film 27 from the etching liquid, thereby protecting the damper film 27 from being damaged by the etching liquid.

Further, because the damper film 27 has a lower elastic modulus than the elastic layers 32 and 33 on the vibration plate 28, it is possible to further improve the effect of absorbing the ink vibration as compared to the case where the damper film 27 is formed from the vibration plate 28.

<Method for Manufacturing the Ink Jet Head>

Referring to FIGS. 11A to 12D, an explanation will be made below about a manufacturing process for the ink jet head 3.

Figure 11A:
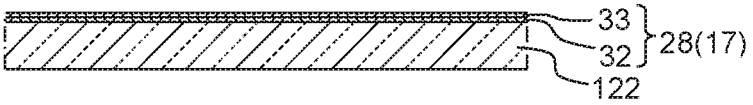
FIGS. 11A to 11E are cross-sectional views depicting a manufacturing process of the ink jet head of FIG. 1.

An operator first forms the elastic layer 32 and the elastic layer 33 to superimpose each other in this order on one surface of the silicon substrate 122 which is the base of the substrate 22. For example, the elastic layer 32 is formed of a $SiO_2$ film while the elastic layer 33 is formed of a $ZrO_2$ film. With that, the vibration plate 28 and the support member 17 are formed (FIG. 11A).

Then, a pattern mask is arranged on the vibration plate 28 and the support member 17. For example, the vibration plate 28 and the support member 17 are patterned by way of dry etching to form the space 17*d* of the support member 17 in the position for forming the channel 320 of the substrate 122 (FIG. 11B).

Figure 11B:
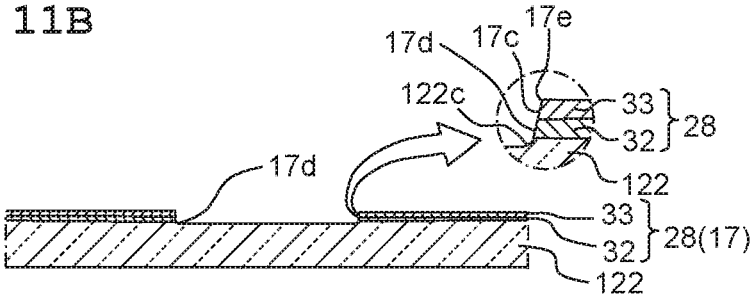

As depicted here in FIG. 11B, in the patterning by way of the etching, an edge part 122*c* of the substrate 122 is formed in the vicinity of the periphery of the space 17*d* of the support member 17, as an inclined part curving gently as viewed from a direction perpendicular to the board surface of the substrate 122.

Figure 11C:
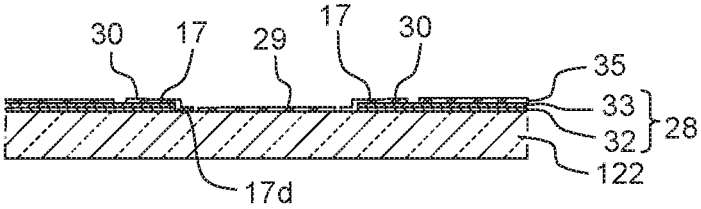

Next, the operator patterns and forms the common electrodes 35*a* and 35*b* on the vibration plate 28 by way of, for example, photolithography (FIG. 11C). On this occasion, by laying out the same material as the common electrodes 35*a* and 35*b* along the surface of the edge part 122*c*, the film 30 is formed to cover the vibration plate 28, the side surface 17*c* of the space 17*d*, and the edge part 122*c* of the substrate 122, with its surface curving gently as viewed from the direction perpendicular to the board surface of the substrate 122. Further, by laying out the aforementioned material on the surface of the substrate 122 exposed to the inside of the space 17*d* of the support member 17, the 400 films 29 are formed.

Figure 11D:
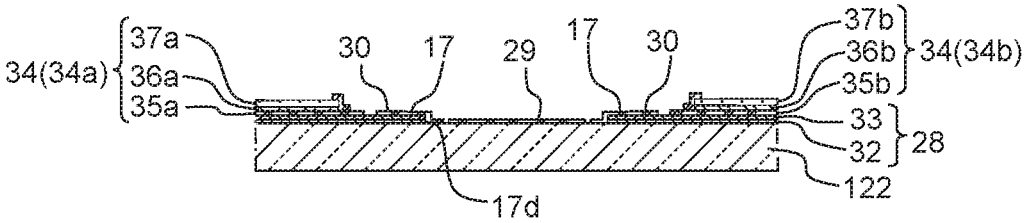

Then, the piezoelectric layers 36*a* and 36*b* are formed to cover part of the common electrodes 35*a* and 35*b* by way of, for example, the sol-gel method, sputtering, liquid phase method, or gas phase method. Further, on the upper surfaces of the piezoelectric layers 36*a* and 36*b*, the individual electrodes 37*a* and 37*b* and the like are patterned and formed by way of, for example, wet etching (FIG. 11D). With that, the actuator 34 is formed to have the piezoelectric elements 34*a* and 34*b*.

Figure 11E:
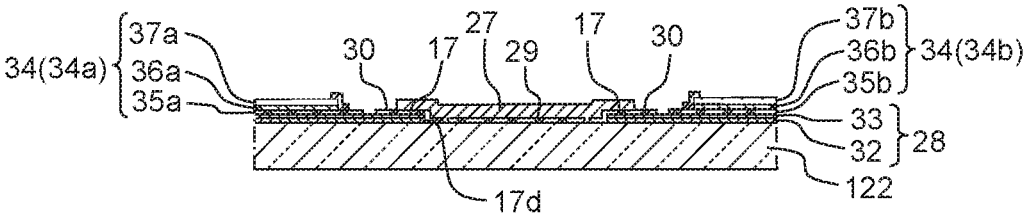

Next, the operator lays out a pattern mask on the upper surface of the vibration plate 28, and places an uncured resin material for forming the damper film 27 to superimpose the upper surface of the vibration plate 28, covering the space 17*d* of the support member 17. In this manner, by curing the placed uncured resin material, the damper film 27 is formed (FIG. 11E). Further, by virtue of this, the film 30 and the film 29 are attached to the lower surface of the damper film 27. Here, if a photoresist is used as the above resin, then it is possible to pattern and form the damper film 27 by way of, for example, photolithography.

Figure 12A:
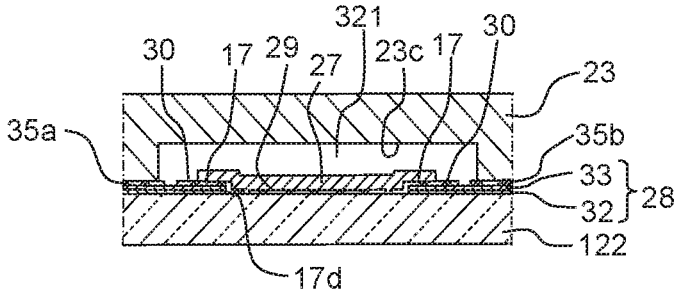
FIGS. 12A to 12D are other cross-sectional views depicting the manufacturing process of the ink jet head of FIG. 1.

On the other hand, the operator obtains the substrate 23 having the operation spaces 316*a* and 316*b* and the displacement space 321 by way of, for example, wet-etching another prepared silicon (Si) substrate. Thereafter, the operator superimposes (joins) the substrate 23 onto the surface of the substrate 122 provided with the vibration plate 28 (FIG. 12A).

Figure 12B:
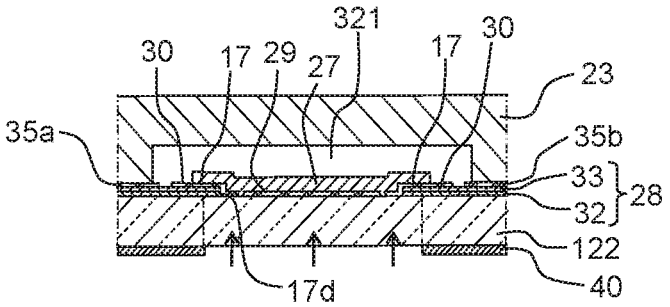

Then, the operator thins the substrate 122. A pattern mask 40 is laid out on the surface of the substrate 122 at the other side than the vibration plate 28, to eliminate, by way of wet etching for example, the part of the substrate 122 for forming the channel 320 (FIG. 12B). By virtue of this, a through hole is formed in the substrate 122 to become the space 22*c*. Next, the operator forms the substrate 22 by dividing (dicing) the substrate 122 into a plurality of chips.

Here, the damper film 27 has a higher toughness than the elastic layers 32 and 33 on the vibration plate 28. Hence, even if the space 22*c* with a comparatively large inner diameter is formed by way of etching, it is still possible to preferably form the substrate 22 while preventing the damper film 27 from damage due to the etching.

Figure 12C:
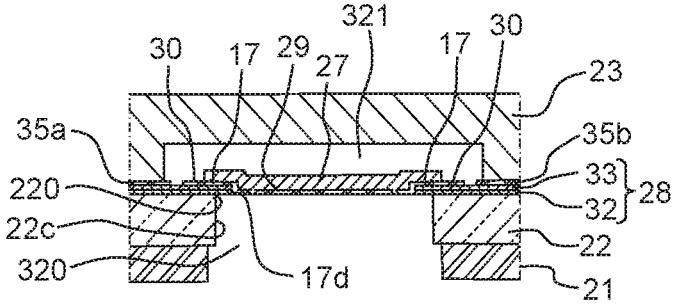

Next, the operator obtains the substrate 21 by way of, for example, wet-etching still another prepared silicon (Si) substrate. Thereafter, the operator superimposes (joins) the substrate 21 onto the substrate 22 (FIG. 12C).

Figure 12D:
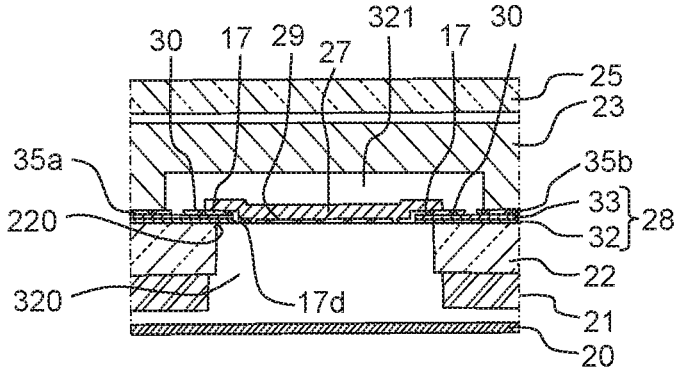

Then, the operator fits the channel member 24 to the substrate 21 and the substrate 23 and, meanwhile, imposes the IC 25 on the upper surface of the substrate 23 and superimposes (joins) the nozzle substrate 20 onto the substrate 21 (FIG. 12D). The channels 300*a* and 300*b* are formed by combining the substrate 21 and the channel member 24. With that, the ink jet head 3 is obtained.

Here, as described above, because the channel 300*a* and the channel 300*b* are formed with the channel member 24 and the other substrate 21 than the substrate 22, it is possible to suppress the width of the substrate 22 along the scanning direction. As a result, it is possible to increase the number of substrates 22 formable from one silicon substrate 122 while reducing the cost for manufacturing the substrate 22.

Further, if the vibration plate 28 doubles as the damper film 27, then it is possible to omit the process (FIG. 11B) for dry-etching the vibration plate 28 for forming the space 17*d*. In this manner, if the vibration plate 28 doubles as the damper film 27, then for example, only the elastic layer 33 may be eliminated by way of dry etching. In such a case, the damper film 27 is formed from the elastic layer 32.

Further, in the above embodiment, such a configuration is exemplified that the common electrodes 35*a* and 35*b* are arranged at a distance from the film 30 along the scanning direction. However, the common electrodes 35*a* and 35*b* may be formed continuous with the film 30. It is possible to pattern the common electrodes 35*a* and 35*b* and the film 30 through the same process using the same metallic material (FIG. 11C).

Further, the conveyance direction in the above embodiment is one example of the first direction. The scanning direction in the above embodiment is one example of the second direction. The vertical direction in the above embodiment is one example of the third direction.

In the above embodiment, the substrate 21 corresponds to the channel member, the pressure chamber 302*a* corresponds to the first pressure chamber, and the pressure chamber 302*b* corresponds to the second pressure chamber. Further, the channel 300*a* corresponds to the first common channel, the channel 300*b* corresponds to the second common channel, and the channel 320 corresponds to the third common channel. Further, the surface S1 corresponds to the first surface, and the surface S2 corresponds to the second surface.

Further, the end E1 corresponds to one of the first end and the second end, while the end E2 corresponds to the other of the first end and the second end. Further, the end E3 corresponds to one of the third end and the fourth end, while the end E4 corresponds to the other of the third end and the fourth end. Further, the end E9 corresponds to the third end, while the end E10 corresponds to the fourth end. Further, the end E5 corresponds to the fifth end, while the end E6 corresponds to the sixth end. Further, the end E7 corresponds to the seventh end, while the end E8 corresponds to the eighth end. Further, the substrate 23 corresponds to the second substrate.

Further, the part 17*h* corresponds to the first part, while the part 17*i* corresponds to the second part. Further, the space 17*d* corresponds to the second space. Further, the elastic layers 32 and 33 correspond to the first layer.

The present teaching is not limited to the above embodiment but, without departing from the true scope and the spirit of the present teaching, the configuration and method thereof may be changed, supplemented, and/or deleted. In the above embodiment, such a configuration is depicted as to arrange the damper film 27, the support member 17, and the films 29 and 30 between the two pressure chamber rows Qa and Qb. However, it is possible to apply such configuration to ink jet heads including pressure chambers included in at least one pressure chamber row, and one common channel in communication with the pressure chambers included in the one pressure chamber row.

What is claimed is:

1. A liquid jetting apparatus comprising:

first pressure chambers aligned in a first direction;

second pressure chambers aligned in the first direction and arranged at a distance from the first pressure chambers in a second direction orthogonal to the first direction;

a first common channel extending in the first direction and communicating with the first pressure chambers;

a second common channel extending in the first direction and communicating with the second pressure chambers;

a third common channel extending in the first direction and communicating with the first pressure chambers and the second pressure chambers;

a substrate having a surface parallel to the first direction and the second direction and being formed with the first pressure chambers, the second pressure chambers, and a space constituting at least part of the third common channel;

vibration plates defining upper surfaces of the first pressure chambers and the second pressure chambers;

piezoelectric elements formed to overlap with the vibration plates respectively; and a damper film defining an upper surface of the space, wherein the space is arranged between the first pressure chambers and the second pressure chambers in the second direction to extend in the first direction, and the damper film covers an opening, on an upper surface side of the substrate, forming the space.

2. The liquid jetting apparatus according to claim 1, further comprising:

an integrated circuit configured to drive the piezoelectric elements; and a wiring member having wires connecting the piezoelectric elements to the integrated circuit, wherein contact points between terminals of the wires and terminals of the piezoelectric elements are arranged not to overlap with the space in a third direction orthogonal to the first direction and the second direction.

3. The liquid jetting apparatus according to claim 2, wherein the substrate has a first end and a second end which are both ends in the second direction, the piezoelectric elements include first piezoelectric elements corresponding to the first pressure chambers respectively and second piezoelectric elements corresponding to the second pressure chambers respectively, the first pressure chambers and terminals of the first piezoelectric elements are arranged between the first end and the space in the second direction, and the second pressure chambers and terminals of the second piezoelectric elements are arranged between the second end and the space in the second direction.

4. The liquid jetting apparatus according to claim 3, wherein the terminals of the first piezoelectric elements are arranged between the first pressure chambers and the space in the second direction, and the terminals of the second piezoelectric elements are arranged between the second pressure chambers and the space in the second direction.

5. The liquid jetting apparatus according to claim 2, wherein the wiring member is a second substrate having a first surface on which the integrated circuit is mounted and a second surface which is opposite to the first surface and formed with the terminals of the wires, and each of the wires has a part formed inside a space which penetrates the second substrate from the first surface to the second surface.

6. The liquid jetting apparatus according to claim 5, wherein the second surface of the second substrate is formed with a recess facing the damper film in the third direction.

7. The liquid jetting apparatus according to claim 1, wherein each of the vibration plates includes a first layer, and the liquid jetting apparatus further comprises a support member constructed of the same layer as the first layer and interposed between the substrate and the damper film, in a third direction orthogonal to the first direction and the second direction, to support the damper film.

8. The liquid jetting apparatus according to claim 7, wherein the damper film has a lower elastic modulus than the first layers.

9. The liquid jetting apparatus according to claim 7, wherein the damper film has a higher toughness than the first layers.

10. The liquid jetting apparatus according to claim 7, wherein the first layer is formed of an inorganic material.

11. The liquid jetting apparatus according to claim 10, wherein the damper film is formed of a resin material.

12. The liquid jetting apparatus according to claim 11, wherein the damper film is formed of photoresist.

13. The liquid jetting apparatus according to claim 7, wherein the substrate has a first end and a second end which are both ends in the second direction, the space has a third end and a fourth end which are both ends in the second direction, the third end is arranged between the first end and the fourth end, the fourth end is arranged between the third end and the second end, the support member has:

a first part which is arranged between the first end of the substrate and the third end of the space in the second direction and interposed between the damper film and the substrate in the third direction; and a second part which projects from the first part toward the fourth end of the space in the second direction, and a side surface of the second part is positioned between the third end of the space and the fourth end of the space.

14. The liquid jetting apparatus according to claim 13, further comprising a film having:

a) a part A interposed between an upper surface of the second part and the damper film;

b) a part B interposed between the side surface of the second part and the damper film; and c) a part C projecting from the part B toward the fourth end of the space in the second direction, wherein an end of the part C is arranged between the third end of the space and the fourth end of the space in the second direction.

15. The liquid jetting apparatus according to claim 14, wherein the film is formed of the same material as an electrode included in each of the piezoelectric elements.

16. The liquid jetting apparatus according to claim 7, further comprising a second space arranged in the space as viewed from the third direction, wherein the support member includes a ring-like portion arranged to enclose the space as viewed from the third direction, a peripheral portion defining the second space, and an extending portion extending from the ring-like portion toward the peripheral portion.

17. The liquid jetting apparatus according to claim 1, further comprising at least one film stacked on a surface, of the damper film, facing the space.

18. The liquid jetting apparatus according to claim 17, wherein the film is formed of the same material as an electrode included in each of the piezoelectric elements.

19. The liquid jetting apparatus according to claim 1, further comprising a channel member defining the first common channel and the second common channel, wherein the substrate has a first end and a second end which are both ends in the second direction, the channel member has a third end and a fourth end which are both ends in the second direction, the first common channel has a fifth end and a sixth end which are both ends in the second direction, the second common channel as a seventh end and an eighth end which are both ends in the second direction, in relation to the second direction, the fifth end, the sixth end, the seventh end, and the eighth end are arranged in this order from the third end toward the fourth end, and the distance from the first end to the second end in the second direction is shorter than the distance from the fifth end to the eighth end in the second direction.

20. The liquid jetting apparatus according to claim 19, wherein the channel member includes a second substrate stacked on a surface, of the substrate, opposite to the surface on which the vibration plates are arranged, and the second substrate defines at least part of the first common channel and at least part of the second common channel.

* * * * *